US007537491B1

(12) United States Patent
Feldman

(10) Patent No.: US 7,537,491 B1
(45) Date of Patent: May 26, 2009

(54) INTERFACE UNIT

(76) Inventor: Michael Feldman, 148 Carl Tennen street, Thornhill, Ontario (CA) L4J 7B1

( * ) Notice: Subject to any disclaimer, the term of this patent is extended or adjusted under 35 U.S.C. 154(b) by 0 days.

(21) Appl. No.: 12/217,894

(22) Filed: Jul. 10, 2008

(51) Int. Cl.
*H01R 25/00* (2006.01)

(52) U.S. Cl. ..... 439/676; 439/63; 439/638; 439/916; 439/941

(58) Field of Classification Search ..... 439/63, 439/76.1, 580, 581, 638, 641, 642, 676, 916, 439/941
See application file for complete search history.

(56) References Cited

U.S. PATENT DOCUMENTS 5,618,185 A * 4/1997 Aekins ..... 439/76.1
5,997,314 A * 12/1999 Wallace et al. ..... 439/63
6,307,513 B1 * 10/2001 Gaucher et al. ..... 343/702
6,417,812 B1 * 7/2002 Tsai ..... 343/725
6,533,618 B1 * 3/2003 Aekins ..... 439/676
6,573,868 B2 * 6/2003 Johnson et al. ..... 343/702
6,729,901 B2 * 5/2004 Aekins ..... 439/418
6,802,743 B2 * 10/2004 Aekins et al. ..... 439/676
6,821,146 B2 * 11/2004 Tolmie ..... 439/577
6,840,816 B2 * 1/2005 Aekins ..... 439/676
6,893,296 B2 * 5/2005 Aekins et al. ..... 439/676
6,896,557 B2 * 5/2005 Aekins et al. ..... 439/676
6,921,146 B2 * 7/2005 Wouters ..... 347/33
6,962,503 B2 * 11/2005 Aekins ..... 439/418
7,172,466 B2 * 2/2007 Aekins et al. ..... 439/676
7,210,966 B2 * 5/2007 Taylor et al. ..... 439/620.09
7,309,260 B2 * 12/2007 Brower et al. ..... 439/676
7,322,832 B2 * 1/2008 Kronich et al. ..... 439/67
7,438,591 B2 * 10/2008 Chen et al. ..... 439/540.1
2003/0031138 A1 * 2/2003 Beckwith ..... 370/278
2003/0119372 A1 * 6/2003 Aekins ..... 439/676
2003/0129872 A1 * 7/2003 Tolmie ..... 439/577

* cited by examiner

*Primary Examiner*—James Harvey

(57) ABSTRACT

The present invention relates to the interface unit and allows using one of RJ-XX type connectors for simultaneously connecting an interface cable and RF antenna unit. Some embodiments of the present invention comprise means of reducing EM influence between said interface cable and RF antenna unit.

17 Claims, 7 Drawing Sheets

INTERFACE UNIT

CROSS REFERENCE TO RELATED APPLICATIONS

This is the first application filed for the present invention.

TECHNICAL FIELD

The present invention relates to the equipment which has both interface cable and RF antenna unit for the connection to the external device.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The high level of integration in the computer industry allows combining different devices into one device. An example of this is a combination of both wired and wireless communication interfaces. This implementation requires a specific solution that allows connecting those internal devices to external devices via external cables. And those different devices can share the same interface unit for each of the devices.

Combination of different devices helps to miniaturize and reduce the cost of the solution.

Using high-speed interfaces raise the problem of EMI (Electro Magnetic Influence) compatibilities between devices. It's known that many patents that are devoted to EMI problems.

The small-sized retractable connector RJ-XX type are used widely for connecting wired communication interfaces, or wireless RF interface antenna, for example, U.S. Pat. No. 6,469,681 (Jones J. L., et al.).

Brower C. J., et al. in U.S. Pat. No. 7,309,260 propose a PCB mountable module including logic circuitry that translates between serial and wireless communication protocols. These modules can be used wherever a device designer wants a plug-in (or "drop-in") system that obviates the need for independent development and maintenance of wireless capability. Said module uses RJ-45 type connector only for wired interface, and all variant shows that an antenna is external to the said module.

Madsen B. D., et al in U.S. Pat. No. 6,174,205, Jonhson T. A., et al in U.S. Pat. No. 6,573,868, use one or more connectors for wired communication interface and one connector for wireless interface for antenna that is mounted separately.

A lot of U.S. Pat. Nos. 6,729,901, 6,802,743, 6,840,816, 6,893,296, 6,962,503, 6,896,557, 7,172,466 (Aekins R et al) dedicate to the problem of protection transmitted information against cross talk by using unshielded twisted pair media ("UTP") and, in particular, by using RJ-45 modular type plugs and connectors.

These patents show importance of struggle against cross talk in RJ-45 type of connectors by use of high-speed interfaces. The basic decisions of this patent group are connected with the placement of pins, in particular in an arrangement of said pins at some angle, placement of said pins in two rows on predetermined vertical distance, mutual disposition of separate interface wires and use mutual cross talks compensation.

These decisions give a positive effect, but require, as a rule, to use not standard (custom made) connectors. And it is suitable only for cross talks compensation between wires of one interface or wires between different interfaces.

Tolmie B. R. in U.S. Pat. No. 6,821,146 proposes a hybrid connector that is capable to unite a set of pins of different types e.g. a group of pins of wired connection and a group of pins of RF signal, and said hybrid connector uses a metallic extruded housing. Said housing has a plurality of connector channels, and these metallic connector channels have metallic walls that separate one signal wires (lines) from another. These metallic walls are shields that exclude a EMI between close signals.

Said hybrid connector allows to use different interfaces in one connector, excepting mutual influence of interface wires one to another, but demands complex and very expensive connectors. The solution cannot be implemented based on standard RJ-XX connector types.

SUMMARY

The first aspect of present invention consists in possibility of using two heterogeneous interfaces, for example, Ethernet and wireless communication RF interfaces that share one common connector. For connection of these interfaces a standard RJ-XX like connector can be used. That connector corresponds to standard bracket and wherein a first lateral interface group of pin positions is separated from the second lateral group of pin positions by a central group of pin positions. Said central group of pin positions includes no less than one position, and said central group of pin positions is free from interface signals.

A second aspect of present invention consists in that one or more said pin positions of the central group are grounded.

A third aspect of present invention consists in that the RF interface antenna is made in view of free-suspended wire.

A fourth aspect of present invention consists in that the RF interface antenna is made in view of rod antenna, disk antenna, dipole antenna, magnetic (ferrite rod) or dielectric antenna.

A fifth aspect consists in that said RF interface antenna is a receiving antenna.

A sixth aspect consists in that said RF interface antenna is a receiving/transmitting antenna.

A seventh aspect consists in that said antenna is an external antenna that is connected to said connector by wire.

BRIEF DESCRIPTION OF THE DRAWINGS

Further features and advantage of present invention will become apparent from the following detailed description, taken in combination with the appended drawing, in which.

DETAILED DESCRIPTION OF THE PREFERRED EMBODIMENTS

Figure 1:
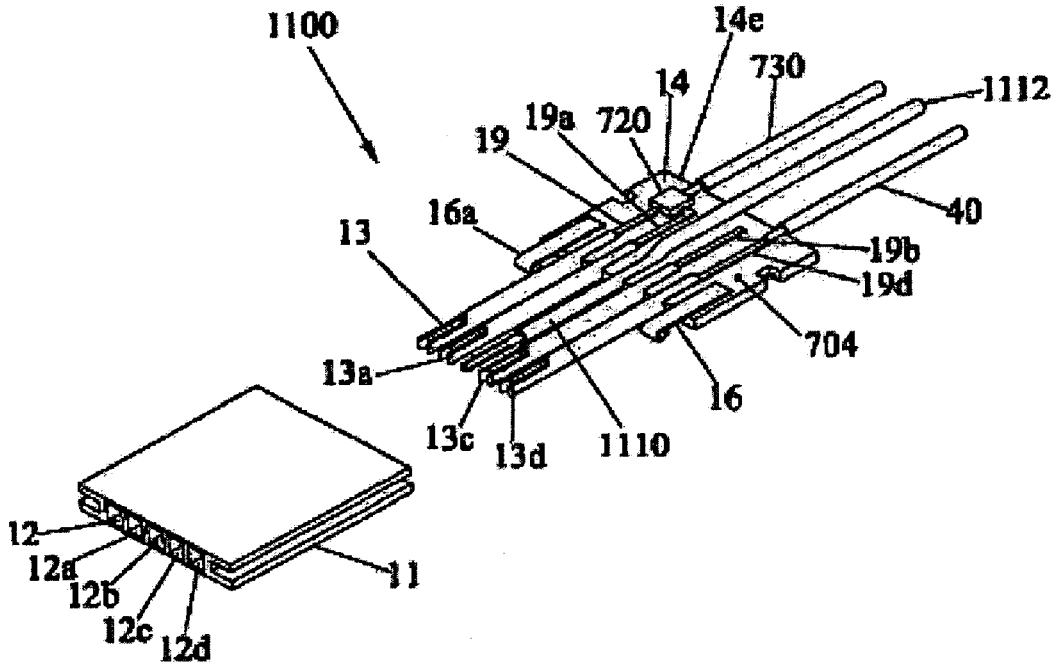
FIG. 1 Prior Art
FIG. 1 is a schematic illustration showing a prior art interface unit according to U.S. Pat. No. 6,821,146.

FIG. 1 shows a prior art of interface unit (hybrid connector) according to U.S. Pat. No. 6,821,146. Hybrid connector 1100 has a metallic extruded housing 11. It has a first plurality of connector channels formed therein during extrusion and accepts one or more of the connector pins, which are capable of providing digital and analog signal transmission. Pin 1110 having an end 1112 and capable of providing RF signal transmission. Further, the presence of laser surface 720 and optical fiber 730 is optional. In an example embodiment, at least one of the solder tails (e.g., 19*b*) corresponding to the removed pins is removed as well, as RF pins 1110 extend beyond the remaining pins, e.g. pins 13A, 13*c*, 13*d*, and out beyond the edge 14E of the IPCB 14. RF pin 1110 is sized to fit into the corresponding channel (e.g., channel 12*b*) of extruded metal housing 11.

Accurate electrical impedance is maintained for RF pin 1110 over a wide range of RF frequencies (e.g., from megahertz to gigahertz) by virtue of the air gap between the insulated walls of the housing channels and the RF pin. The size of the channels can be selected to achieve a desired air gap and thus a desired impedance value.

An advantage of hybrid connector 1100 is that both high-speed electrical digital signals and RF signals can be transmitted in a single connector. This allows for a high signal density as compared to using individual standard high-frequency connectors. The higher signal density is achieved, in part by the rectangular shape of the housing and the multiple channels formed therein, as compared to a round connector with a single channel formed therein.

Said advantages of said hybrid connector (U.S. Pat. No. 6,821,146) are achieved by using not standard, expensive and intricate connectors.

Figure 2:
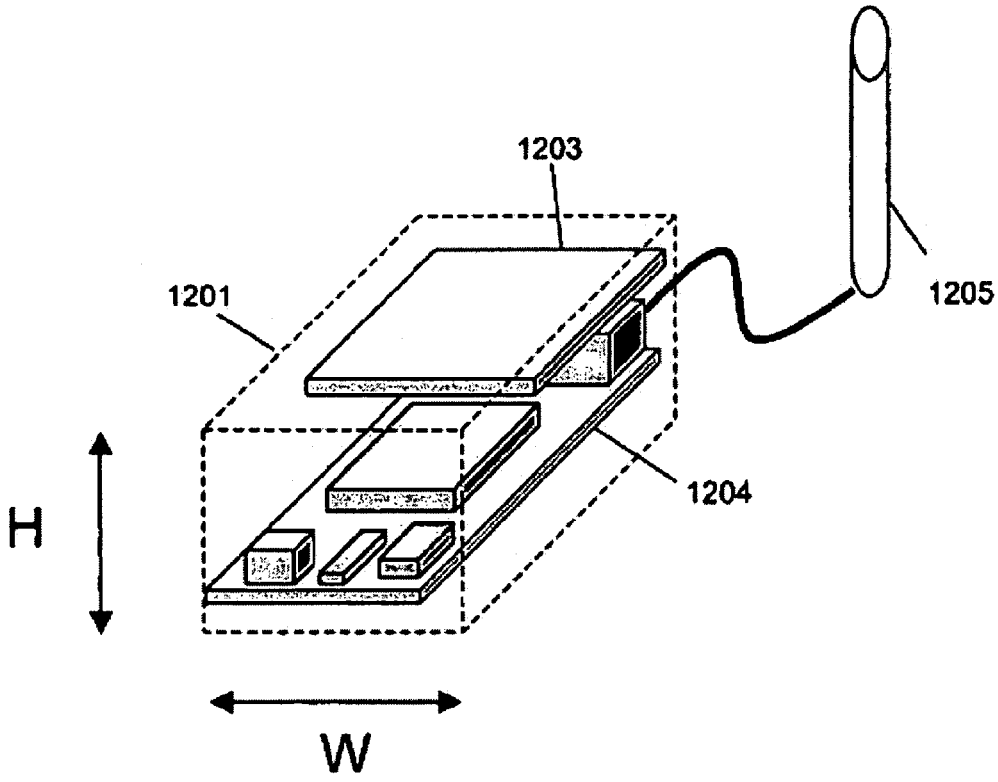
FIG. 2 Prior Art
FIG. 2 is a schematic illustration showing a prior art antenna disposition according to US Pat. Appl. 20030031138.

FIG. 2 shows a prior art antenna disposition according to US Pat. Appl. 20030031138. This antenna 1205 is mounted on a housing of device. It is connected to the internal unit of device and doesn't share connector with any communication interfaces.

Figure 3:
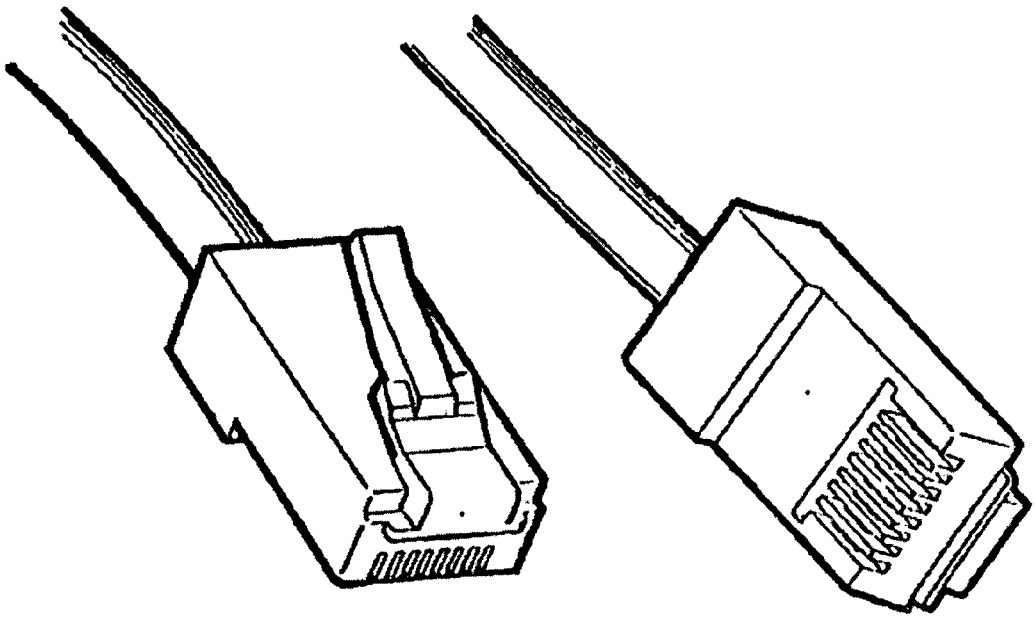
Prior Art FIG. 3
FIG. 3 is a schematic illustration showing a plug RJ-45 according to §68.500 of Federal Communications Commission.
Figure 4:
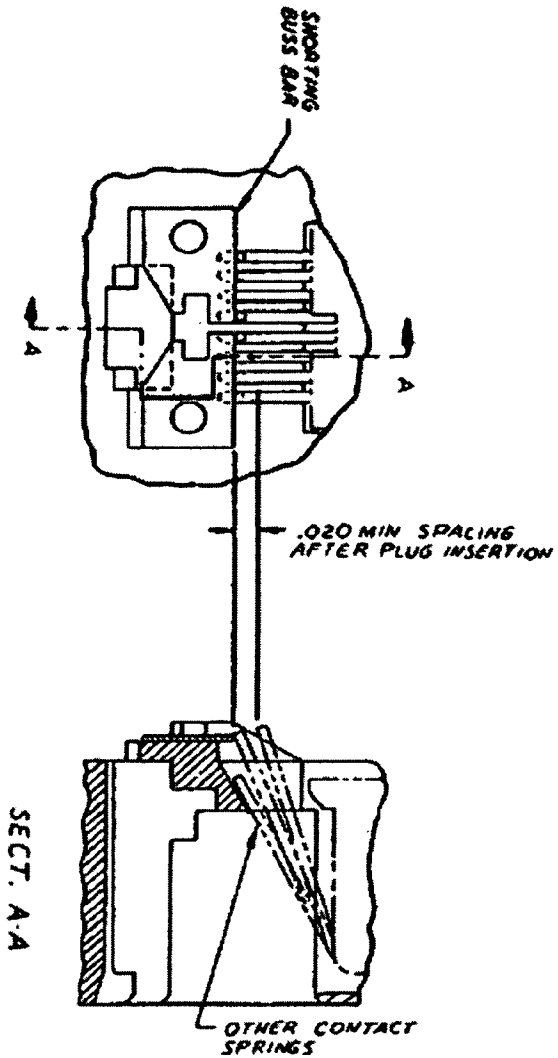
Prior Art FIG. 4
FIG. 4 is a schematic illustration showing a connector RJ-45 according to §68.500 of Federal Communications Commission.

FIGS. 3 and 4 show the standard view of RJ-45 (a plug and a connector correspondently) according to §68.500 of Federal Communications Commission.

Figure 5:
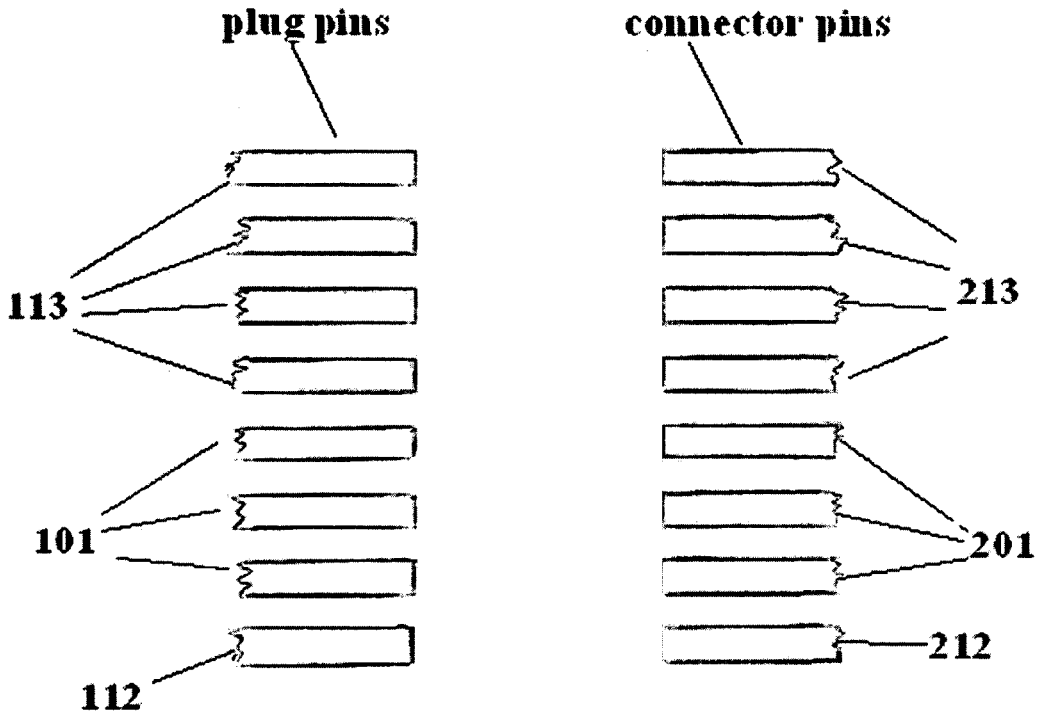
FIG. 5 shows one possible variants of distribution of the pin groups between connector plug and connector itself.

FIG. 5 shows one possible variant of distribution of the pin groups between connector plug and connector itself according to present invention. Groups of pins 113 and 213 are intended to Ethernet interface (for example). The pin 112 is the pin for external RF antenna unit connection. The pin 212 is connected to RF radio unit, for example, tuner or unit for RF receiving/transmitting. The pins of center (third) group—101 and 201, correspondently, are intended for separation of two pin groups 113 (213) and 112 (212). Even if pins in the center group are not connected the distance between first and second lateral groups significantly reduce EMI between signals of both groups. To additionally reduce EMI one or more pins of the central group can be connected to ground or shield.

Figure 6:
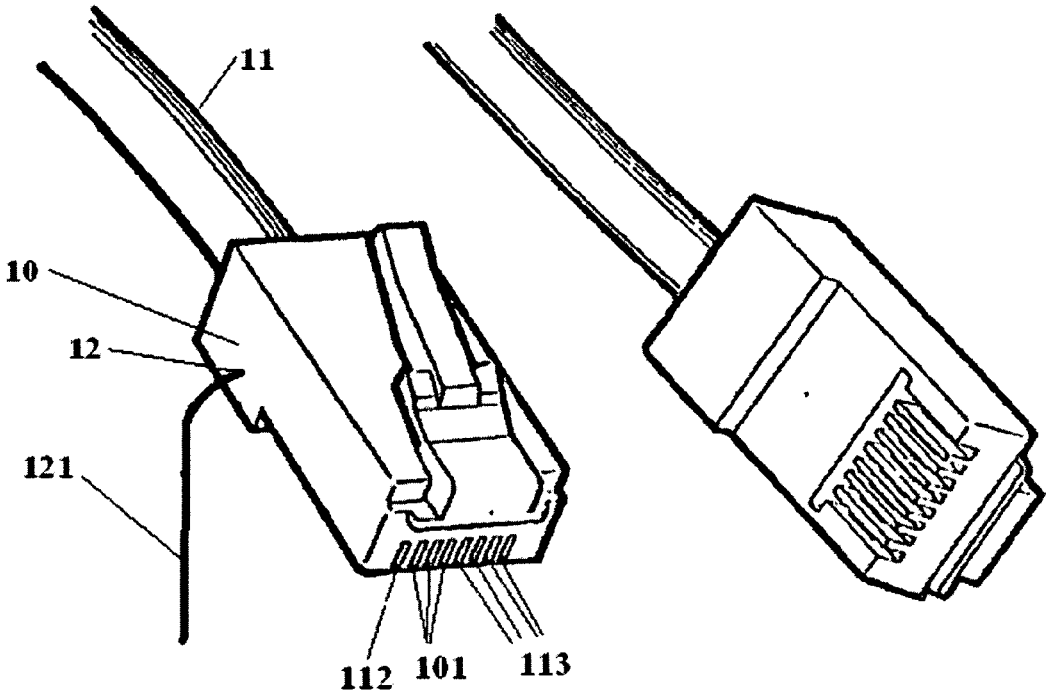
FIG. 6 shows one possible variants of using RF interface antenna in view of free-suspended wire.

FIG. 6 shows one possible variant of the antenna in the view of the free-suspended wire 121 that is connected to the RF antenna unit output 12. This wire 121 is connected to the pin 112 inside said plug 10.

Figure 7:
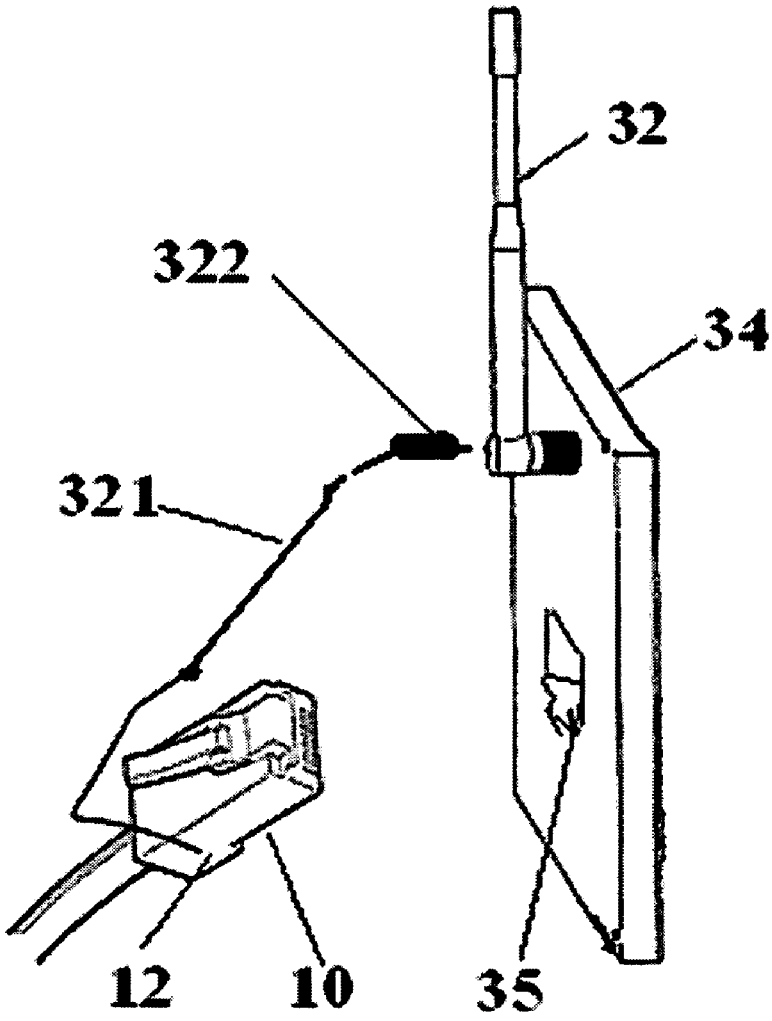
FIG. 7 shows another possible implementation of using RF interface antenna.

FIG. 7 shows a second possible case of the antenna 32 in the view of the rod that is placed, for example, on the bracket 34 and is connected to the RF antenna unit output 12 via a cable 321 and a connector 322.

In the design of FIG. 7 any antenna type instead of the rod 32 can be used, any antenna type that is suitable for a RF range and its sizes, for example, disk, ferrite, dipole antenna etc.

I claim:

1. A interface unit comprising:

a RJ-XX-type connector been intended for mounting on printed circuit board, a plug been intended for inserting into said RJ-XX-type connector, a housing of said RJ-XX-type connector having an interior in communication with an input opening that is configured to accept said plug, a communication interface cable, one or more RF antenna units, said communication interface cable and one or more RF antenna units are connected to said plug, said interface unit wherein said plug has not more pin positions than said connector, said pin positions may be divided into at least three separate sequentially groups of said pin positions:

first and second lateral position groups and one central position group correspondently, and said central position group comprises no less than one position, said connector and said plug wherein:

one of said lateral position groups is intended for said communication interface cable and includes the correspondent number of said pins, another of said lateral group is intended for one or more said RF antenna units and intended for at least receiving RF signals, said central position group is intended for reducing of EMI between signals of said lateral groups.

2. The interface unit according to claim 1, wherein said interface unit is mounted on the PC plug-in card that can be inserted into PC housing.

3. The interface unit according to claim 1, wherein said pins belonging to said central group and wherein at least one of said pins is connected to ground.

4. The interface unit according to claim 1, wherein said pins belonging to said central group and wherein at least one of said pins is connected to a shield.

5. The interface unit according to claim 1, wherein said pins belonging to said central group and wherein at least one of said pins is connected to one of electric circuit conductors and their potential is practically constant during to operating time.

6. The interface unit according to claim 1, wherein said pin positions belonging to said central group are not connected pins positions.

7. The interface unit according to claim 1, wherein said communication interface cable is intended for one of high speed communication interfaces.

8. The interface unit according to claim 7, wherein said high speed communication interface is a 10/100/1000 Mbit Ethernet.

9. The interface unit according to claim 1, wherein said connector has a shielded housing.

10. The interface unit according to claim 1, wherein at least one of said RF antenna unit is made in the view of a free-suspended wire.

11. The interface unit according to claim 2, wherein at least one of said RF antenna units comprises a wire, one end of said wire is connected to at least one corresponding conductor of said second group, and a second wire end is ended by a patch plug and is intended for connecting to at least one external antenna that may be mounted on said PC housing.

12. The interface unit according to claim 4, wherein at least one of said antenna units comprises a cable having a central wire and a shield or a braided shield, one end of said wire is connected to at least one of a corresponding conductor of said second group, and a second wire end is intended for connecting to at least one external antenna and said braided shield is connected to at least one shielded conductor of said central group.

13. The interface unit according to claim 1, wherein said antenna is chosen from the group, including:

simple-wire antenna including a free-suspended wire, (free-suspended wire), rod antenna, disk antenna, dipole antenna, magnetic including a ferrite rod or dielectric antenna.

14. The interface unit according to claim 1, wherein said antenna is intended for receiving/transmitting RF signals.

15. The interface unit according to claim 1, wherein said communication interface cable is made in the form of a flat cable.

16. The interface unit according to claim 1, wherein said communication interface cable is made in the form of a twisted pair cable.

17. The interface unit according to claim 1, wherein said RJ-XX-type connector is chosen from the group including: RJ-11, RJ-21, RJ-45, RJ-48.

* * * * *